US005197502A

United States Patent [19]

Wang

[11] Patent Number: 5,197,502

[45] Date of Patent: Mar. 30, 1993

[54] WALKING STICK

[76] Inventor: Lee M. Wang, No. 95, Chu Wei Wei, Chiao Nan Li, Yen Shui Chen, Tainan Hsien, Taiwan

[21] Appl. No.: 648,959

[22] Filed: Feb. 1, 1991

[51] Int. Cl.[5] ..... A61H 3/02

[52] U.S. Cl. ..... 135/69; 135/68

[58] Field of Search ..... 135/68, 69, 72, 73, 135/75

[56] References Cited

U.S. PATENT DOCUMENTS

| | | | |
|---|---|---|---|
| 1,157,314 | 10/1915 | Compte | 135/73 |
| 3,032,048 | 5/1962 | Hoffmann | 135/72 |
| 4,721,125 | 1/1988 | Wang-Lee | 135/68 |
| 5,050,692 | 9/1991 | Beimgraben | 1/1 |

FOREIGN PATENT DOCUMENTS

| | | | |
|---|---|---|---|
| 463774 | 5/1950 | Canada | 135/67 |
| 187555 | 7/1907 | Fed. Rep. of Germany | 135/69 |
| 115731 | 5/1918 | United Kingdom | 135/68 |

*Primary Examiner*—Henry E. Raduazo

*Attorney, Agent, or Firm*—Morton J. Rosenberg; David I. Klein

[57] ABSTRACT

A walking stick is aimed to resolve conventional problems provided with durable structure, which generally has a circular cross-sectional pipe frame formed of two semi-circular pipe members connected with ribs in between. The pipe frame is cut to separate to a suitable position, such that cut portion of pipe frame may be extended outwardly to form U-shaped bifurcated pipe, and secured with supporting cushions on the top to partially support body weight of the user. The other end of pipe frame is connected with a hollow shaft, so made that it is adjustable by means of resilient clamping means.

3 Claims, 2 Drawing Sheets

WALKING STICK

BACKGROUND OF THE INVENTION

The present invention relates to walking sticks and particularly to the kind known as crutches for releasable mounting under the user's armpits.

PRIOR ART

Crutches or walking sticks are well known in the prior art. One such prior art walking stick or crutch is shown in FIG. 1. In this type of crutch three circular pipes 1 are provided which are connected by a rib 13 to each other. A suitable length of vertically directed central pipe 11 is provided between bifurcated pipes 12 which are further bent to form a U-shaped pipe frame. A plurality of through holes 121 are formed through said U-shaped frame to receive a cushion 4. The central pipe frame 11 is provided in a suitable length so that it is substantially longer than the pipes 12 to receive a supporting pipe 2 via a bias spring 21 disposed between aligned through holes formed in central pipe 11 and supporting pipe 2.

Although such prior art systems may satisfy basic needs, such are subject to some disadvantages, for instance, material is wasted during manufacturing and the overall system is comparatively heavy which increases the manufacturing and shipping costs and is cumbersome for the user to manipulate.

SUMMARY OF THE INVENTION

The present invention utilizes a circular or elliptical cross-sectional pipe formed of two semi-circular or semi-elliptical pipe members connected by ribs therebetween. The ribs of the pipe are removed at a suitable location and the remaining pipe members are bent to form a U-shaped pipe frame. Supporting cushions are placed on the top of the U-shaped frame to partially support the body weight of the user.

A hollow shaft is further connected to a lower portion of the cut pipe members and is attached to the pipe frame by a resilient clamping mechanism.

It is an objective of the present invention to provide a walking stick which is light in weight and compact in size.

It is a still further object of the present invention to save material during manufacture.

DETAILED DESCRIPTION OF THE PREFERRED EMBODIMENTS

Figure 1:
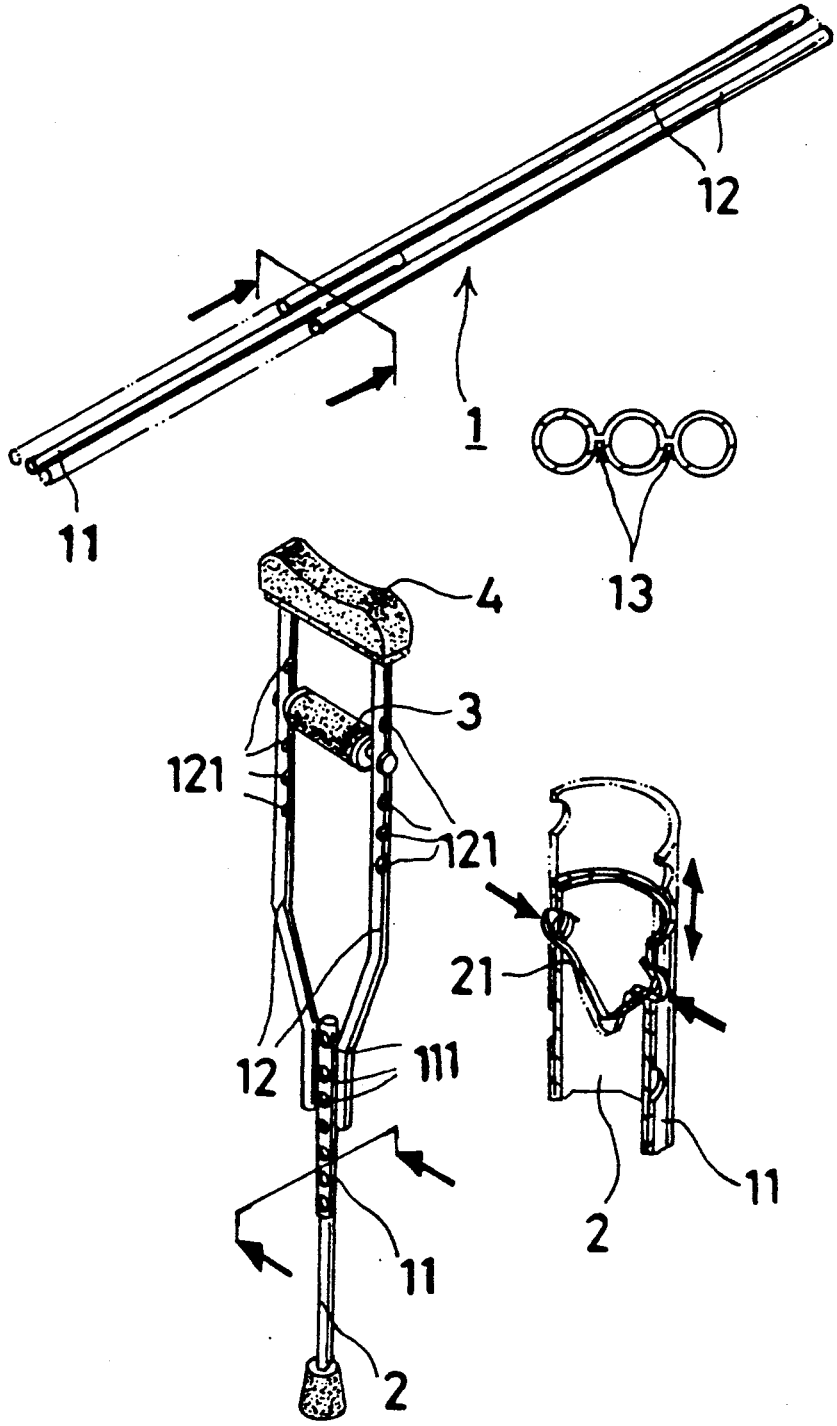
FIG. 1 (PRIOR ART)
FIG. 1 is a perspective view of a prior art walking stick.
Figure 2A:
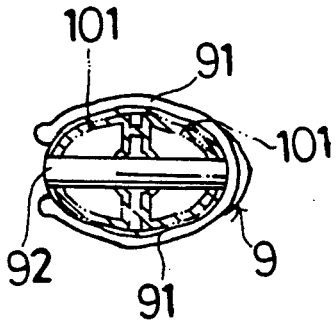
FIG. 2A is a cross-section of the present invention taken along the section line A—A of FIG. 2 when the pipe members are semi-elliptical in contour.
Figure 2B:
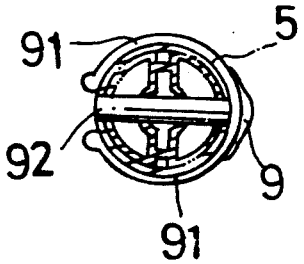
FIG. 2B is a cross-section of the present invention taken along the section line A—A of FIG. 2 when the pipe members are semi-cylindrical in contour.
Figure 2:
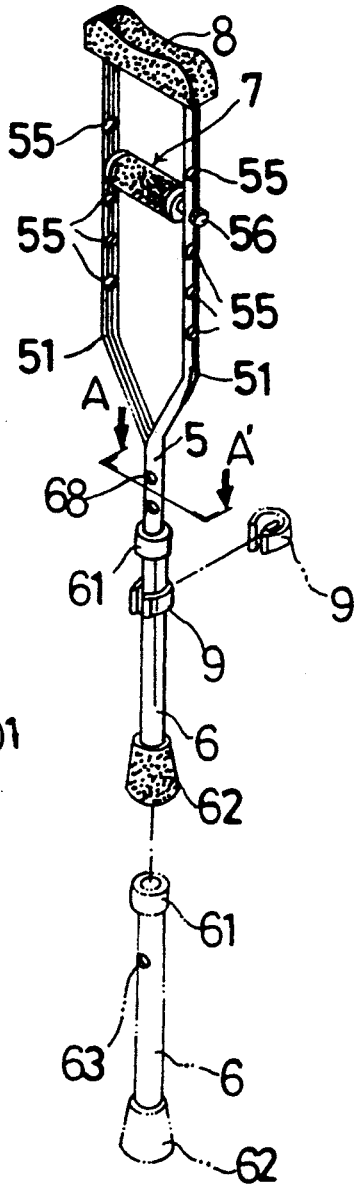
FIG. 2 is a perspective view of the present invention.
Figure 2E:
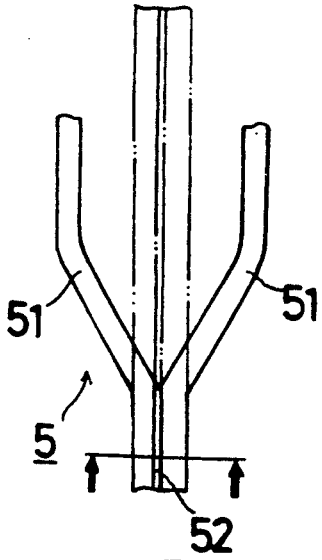
FIG. 2C is a cross-section of a lower portion of the pipe frame when the pipe members are semi-elliptical in contour.
FIG. 2D is a cross-section of a lower portion of the pipe frame when the pipe members are semi-cylindrical in contour; and, FIG. 2E is a partially cut-away elevational view of the upper portion of the pipe frame.
Figure 2C:
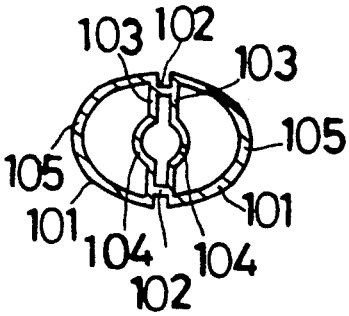
Figure 2D:
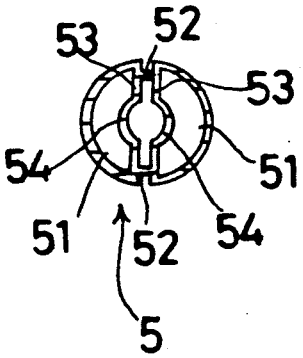

Referring now to FIG. 2, there is shown a walking stick which generally comprises circular pipe frame 5 having two semi-circular closed contour pipe members 51 connected by a pair of ribs 52 extending between the pipe members 51 shown in FIG. 2D. The semi-circular closed contour pipe members 51 further have smaller coaxial, semi-circular defining inner walls 54, and the remaining section defining planar walls 53 to increase resistance to bending moments applied during use. Pipe frame 5 is cut in half through ribs 52 to a suitable location and then separated with the semi-circular pipe members 51 bent to form a U-shaped bifurcated pipe as shown in FIGS. 2 and 2E.

A plurality of through holes 55 are formed through U-shaped bifurcated pipe members 51 in aligned fashion as shown. A pin or bolt 56 with a suitable securement is then inserted through holes 55. A holder 7 is mounted between pipe members 51 to assist the user's control of the walking stick.

The lower portion of pipe frame 5, where ribs 52 are not removed or cut is inserted into a hollow shaft or sleeve 6 for support and adjustment purposes. The hollow shaft 6 has a ring member 61 mounted at an upper end, and a cushion member 62 mounted at a bottom end.

A plurality of through holes 58 are provided in vertical alignment on the lower portion of pipe frame 5 which corresponds to an opening 63 formed through hollow shaft 6 to receive pin 92 of locking mechanism 9. Locking mechanism 9 has a pair of resilient clamp members of C-shaped contour facing inwardly to clamp on the outer circumference of hollow shaft 6 as pin 92 of locking mechanism 9 is inserted into through hole 63 of hollow shaft 6 and further into through hole 58 of the pipe frame 5 as shown in FIGS. 2A and 2B.

Additionally, a supporting cushion 8 is mounted on the top of bifurcated pipe members 51 for contiguous interface with the armpit of a user as an aid to assist walking of an injured person.

While there has been shown a preferred embodiment of the present invention, it is obvious to one skilled in the art that various changes of structure and elements may be within the scope of the invention. For example, semi-circular pipe members 51 may be replaced as half-elliptical cross-section pipe members 101 connected by ribs 102 provided with a plane wall 103 and inner walls 104, whereby outer pipe walls 105 are substantially thicker than inner walls 104 to additionally resist bending moments.

Consequently it is to be understood that the embodiment shown and described is by way of illustration and not of limitation, and that various changes may be made in the construction, composition and arrangement of parts without limitation upon or departure from the spirit and scope of the invention, or sacrificing any of the advantages thereof inherent therein, all of which are herein claimed.

What is claimed is:

1. A walking stick comprising:

a pipe frame having an upper portion and a lower portion, said pipe frame formed of a pair of closed contour pipe members, each of said closed contour pipe members having an arcuate wall member and an inner wall member having a planar section, said lower portion of said pipe frame having said closed contour pipe members fixedly coupled each to the other by a rib member fixedly secured to each of said pipe member planar sections on opposing ends thereof, said upper portion of said pipe frame being bifurcated whereby each of said closed contour pipe members are displaced each from the other;

a support cushion mounted on an upper end of each of said closed contour pipe members;

a holding member mounted between said closed contour pipe members of said upper portion of said pipe frame; said holding member secured to each of said closed contour pipe members by a pair of pin members insertable through a pair of aligned openings formed through each of said closed contour pipe members;

a hollow shaft for insert of said lower portion of said pipe frame; said hollow shaft and said lower portion of said pipe frame having cooperating through openings; and, resilient clamp means having a pin member extending between a pair of C-shaped arms, said pin member passing through said cooperating through openings, said C-shaped arms substantially encircling said hollow shaft.

2. The walking sticks as recited in claim 1 where said arcuate wall members are formed in a substantially semi-circular contour.

3. The walking stick as recited in claim 1 where said arcuate wall members are formed in a substantially semi-elliptical contour, said arcuate portion of each of said closed contour pipe members being thicker in dimension than said planar portion to resist bending moments.

* * * * *